United States Patent [19]

Shikatani

[11] Patent Number: 4,472,836

[45] Date of Patent: Sep. 25, 1984

[54] METHOD TO RETAIN SHAPE OF CURVED GLOVES

[75] Inventor: Tokuichi Shikatani, Higashi, Japan

[73] Assignee: Fuji Industry Co., Ltd., Kagawa, Japan

[21] Appl. No.: 476,378

[22] Filed: Mar. 17, 1983

[51] Int. Cl.[3] ..... A41D 19/02

[52] U.S. Cl. ..... 2/169; 223/79

[58] Field of Search ..... 223/78, 79, 80, 66; 2/169; 264/230, 346; 69/21

[56] References Cited

U.S. PATENT DOCUMENTS

| | | | |
|---|---|---|---|
| 2,343,220 | 2/1944 | Mason | 2/169 |
| 3,377,627 | 4/1968 | Madnick | 2/169 |
| 4,051,552 | 10/1977 | Widdemer | 2/161 A |
| 4,084,733 | 4/1978 | Perlmutter | 223/78 |
| 4,209,913 | 7/1980 | Wallin et al. | 223/79 |

FOREIGN PATENT DOCUMENTS

| | | | |
|---|---|---|---|
| 2308245 | 2/1973 | Fed. Rep. of Germany | 2/161 A |

*Primary Examiner*—Werner H. Schroeder
*Assistant Examiner*—Tracy G. Graveline
*Attorney, Agent, or Firm*—Wenderoth, Lind & Ponack

[57] ABSTRACT

There is provided a method for retaining the shape of gloves e.g. leather golf gloves with one or more curved fingers by placing a glove on an electrically heated form having a shape corresponding to the curved gloves, with a sheet of paper between said form and the interior of the glove, for a sufficient time to retain the shape of the glove, especially the curvature of the fingers thereof.

7 Claims, 8 Drawing Figures

METHOD TO RETAIN SHAPE OF CURVED GLOVES

BACKGROUND AND OBJECTS OF THE INVENTION

Pre-curved gloves, particularly, golf gloves have become increasingly popular. Such glove is disclosed, for example, in U.S. Pat. No. 4,051,552. However, after manufacture of the glove, the glove tends to lose its shape. Therefore, it is an object of the present invention to provide a method for retaining the shape of the glove, and in particular, the curved shape of the finger portions.

BRIEF SUMMARY OF THE INVENTION

After producing a glove with curved fingers, the glove shape is set with an electrically heated form by placing the glove over the form having curve fingered-like projections, the form generally conforming to the shape of the glove. Before setting the glove, a sheet of paper generally conforming to the shape of the glove is inserted in the glove so that it is interposed between the glove and the electrically heated form.

The paper sheet extends from outside the glove, e.g. the cuff back area to the finger tips.

After remaining on the heated form for a sufficient time, the glove with paper therein is removed. The paper sheet remains inside the glove and supports the glove with curved fingers.

The glove produced substantially retains its curved shape after setting in accordance with the present method.

This method is particularly useful for the formation of golf gloves and baseball batters' gloves.

DETAILED DESCRIPTION OF THE INVENTION

The invention will now be further described by reference to the accompanying drawings.

Figure 1:
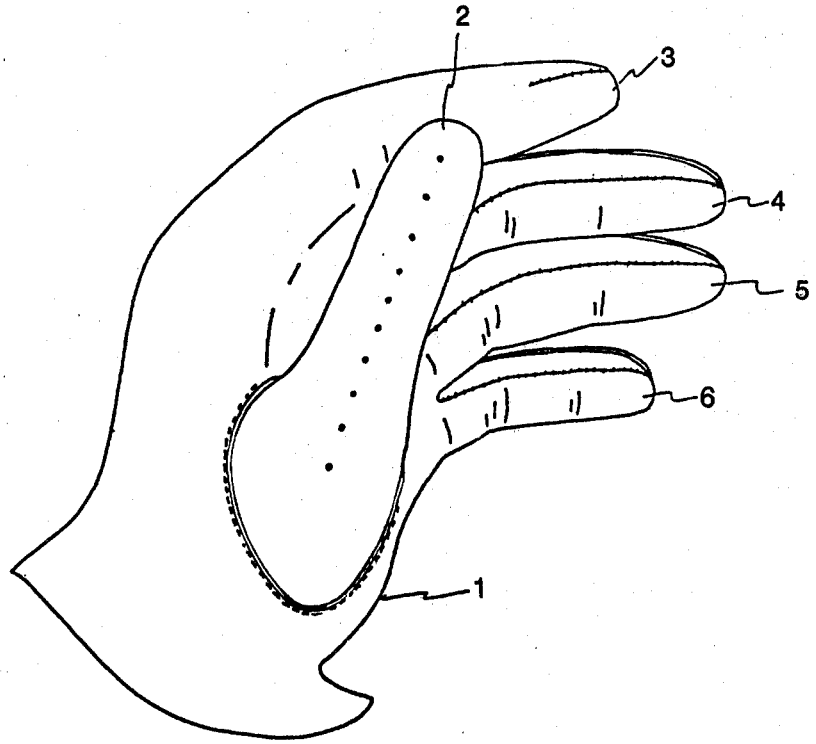
FIG. 1 PRIOR ART
FIG. 1 is a perspective view of a known golf glove produced in accordance with the present method.

FIG. 1 depicts a leather glove (1) wherein the fingers are sewn into a curved shape, except for the thumb. Consequently, the glove facilitates grasp of the golf club, as explained in U.S. Pat. No. 4,051,552.

All of the fingers, i.e. forefinger (3), middle finger (4), third finger (5) and little finger (6), except for thumb (2), are cut in different lengths or shorter lengths on the palm side than on the back side of the finger, respectively. This is disclosed in Japanese patent application 78656/81 by the present inventor.

Figure 2:
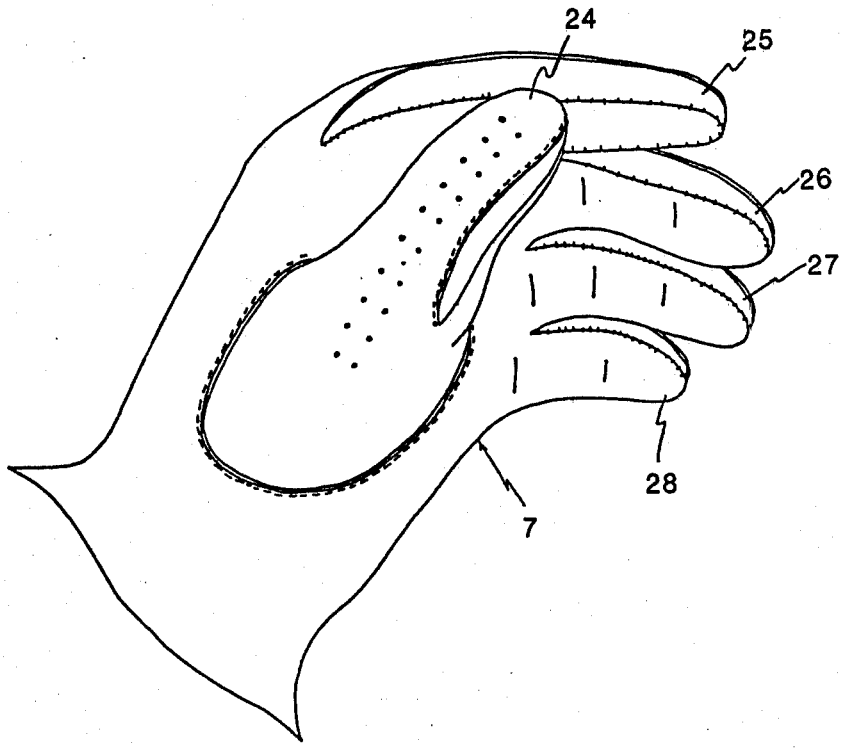
FIG. 2 PRIOR ART
FIG. 2 is a perspective view of a known glove for baseball batters, produced in accordance with the present method.

FIG. 2 depicts baseball batters' glove (7), the fingers of which are curved by sewing with shorter fingers on the palm side than on the back side. The glove facilitates grasp of the bat in a baseball game and this is the subject of Japanese patent application 78657/1981 by the present inventor. This glove comprises thumb (24), forefinger (25), middle finger (26), third finger (27), and little finger (28).

Figure 8:
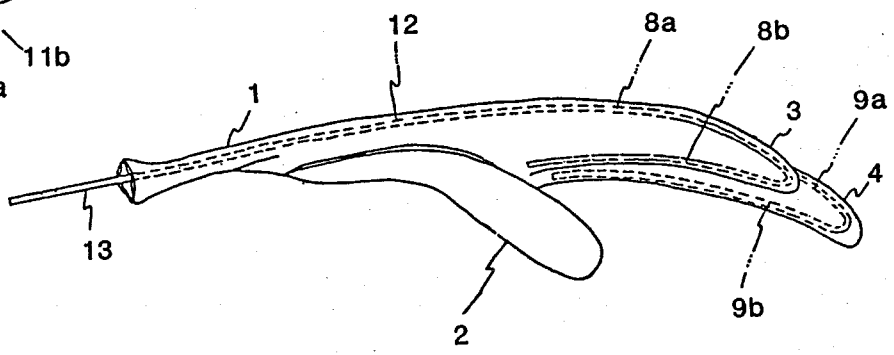
FIG. 8 is a side view of the glove of FIG. 7.
Figure 7:
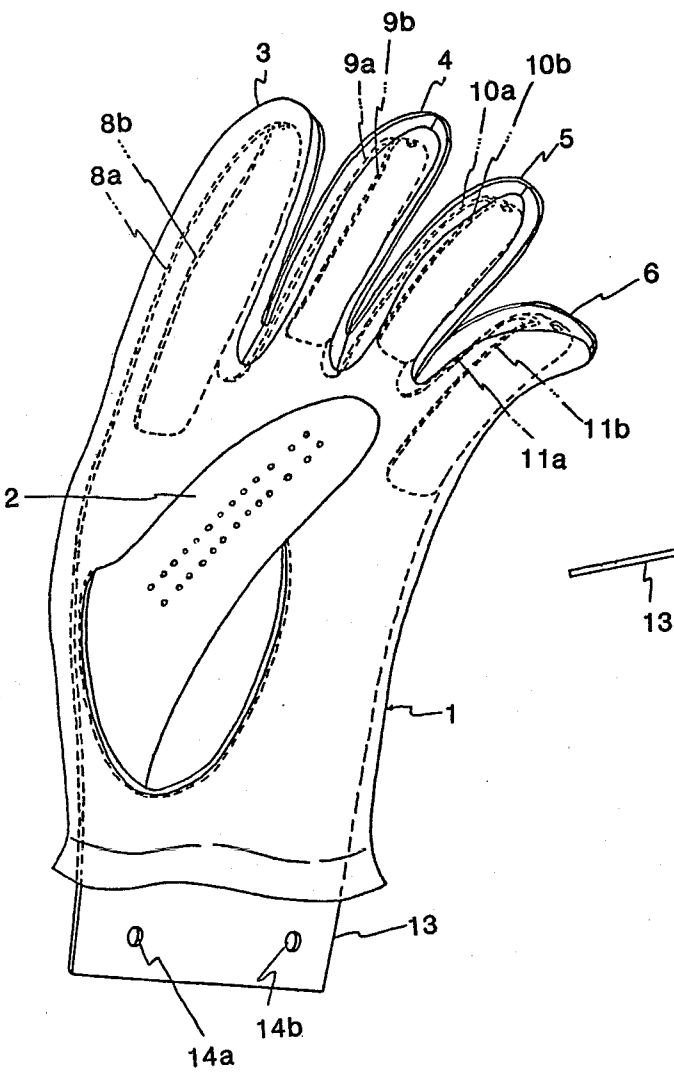
FIG. 7 is a perspective view of the glove after removal from the electrically heated form of FIG. 4.

Before inserting the glove on the electrically heated form, a paper sheet is attached to the form, preferably at two points, i.e. outside the glove corresponding to the cuff back (12) (FIGS. 3 and 8) and at the top of the fingers in proximity to the mid-portion thereof.

After the paper is affixed to the form, the gloves are placed over the form and are permitted to remain there for a sufficient time to set the curved shape of the glove.

The paper layer remains inside the glove and this facilitates retention of the curved shape after removal of the glove from the electrically heated form.

Figure 3:
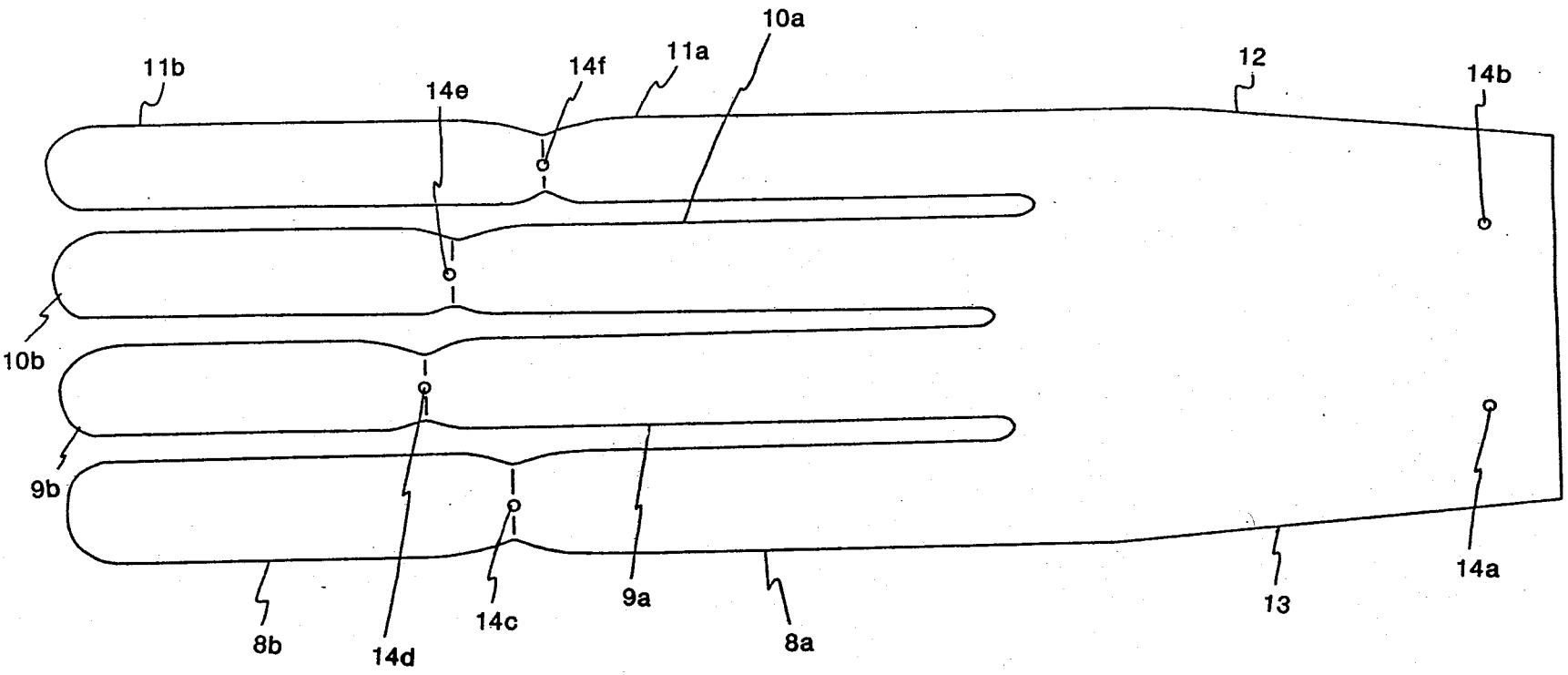
FIG. 3 is a plane view of the paper sheet in accordance with the present invention.

To further clarify this method, FIG. 3 depicts a paper sheet (13) to be inserted into a glove.

The paper sheet comprises forefinger (8*a*), palm side of forefinger (8*b*), middle finger (9*a*), palm side of middle finger (9*b*), third finger (10*a*), palm side of third finger (10*b*), little finger (11*a*) and palm side of little finger (11*b*).

Further, small holes (14*a*) and (14*b*) are provided in the cuff back area and small holes (14*c*), (14*d*), (14*e*) and (14*f*) are provided at the top of the finger in proximity to the mid-portion thereof.

Figure 4:
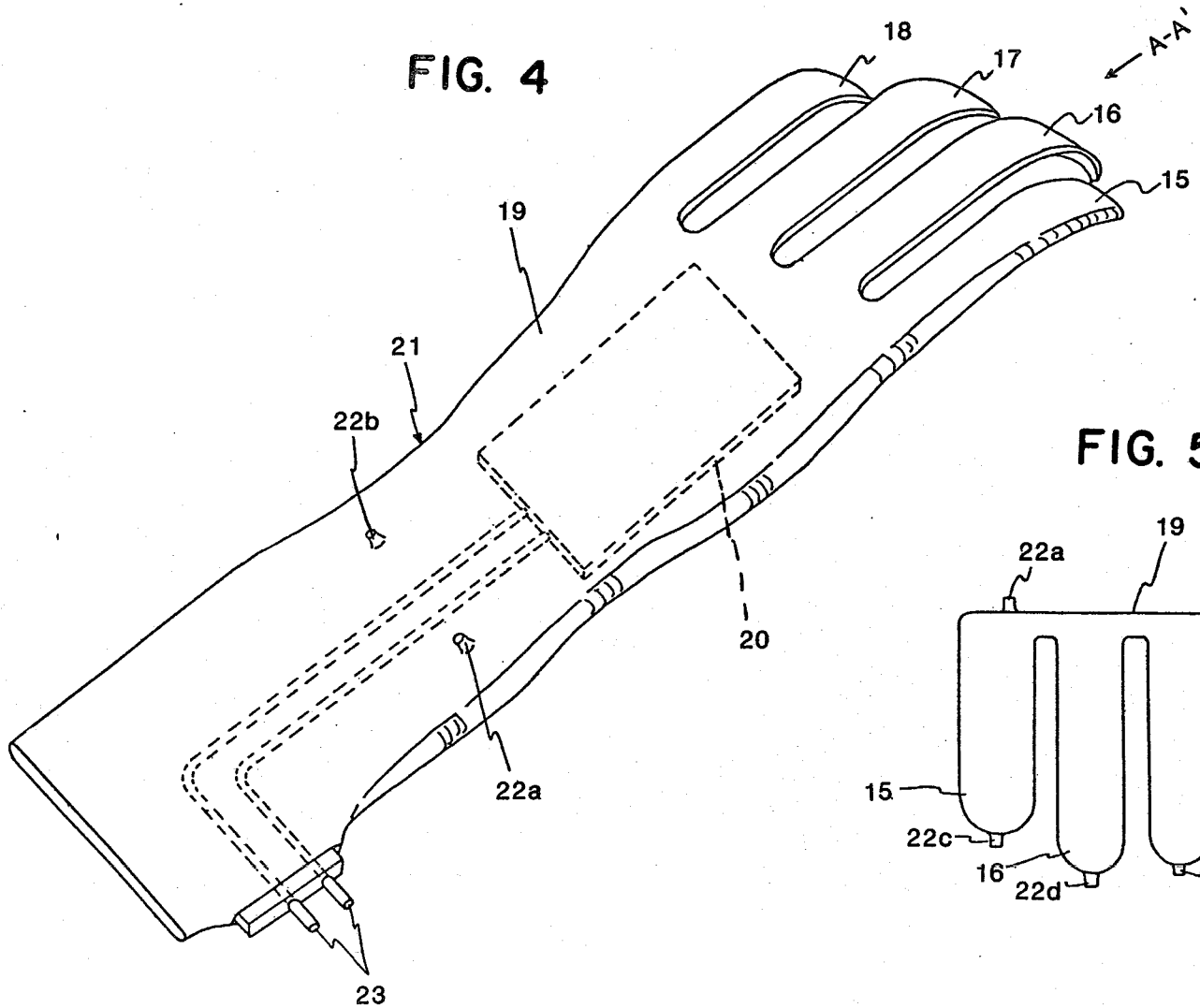
FIG. 4 is a perspective view of the electrically heated form used herein.
Figure 5:
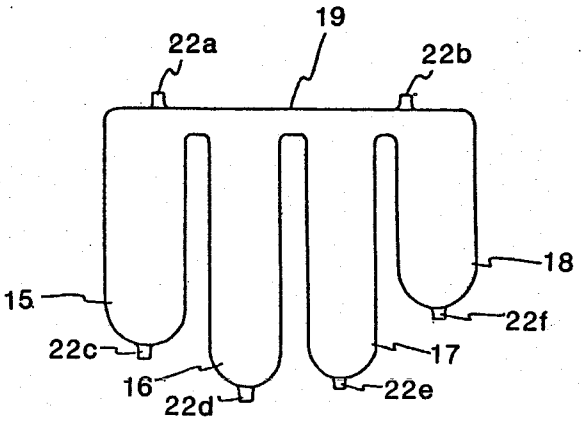
FIG. 5 is a front view of the electrically heated form of FIG. 4, along line A–A$^1$.
Figure 6:
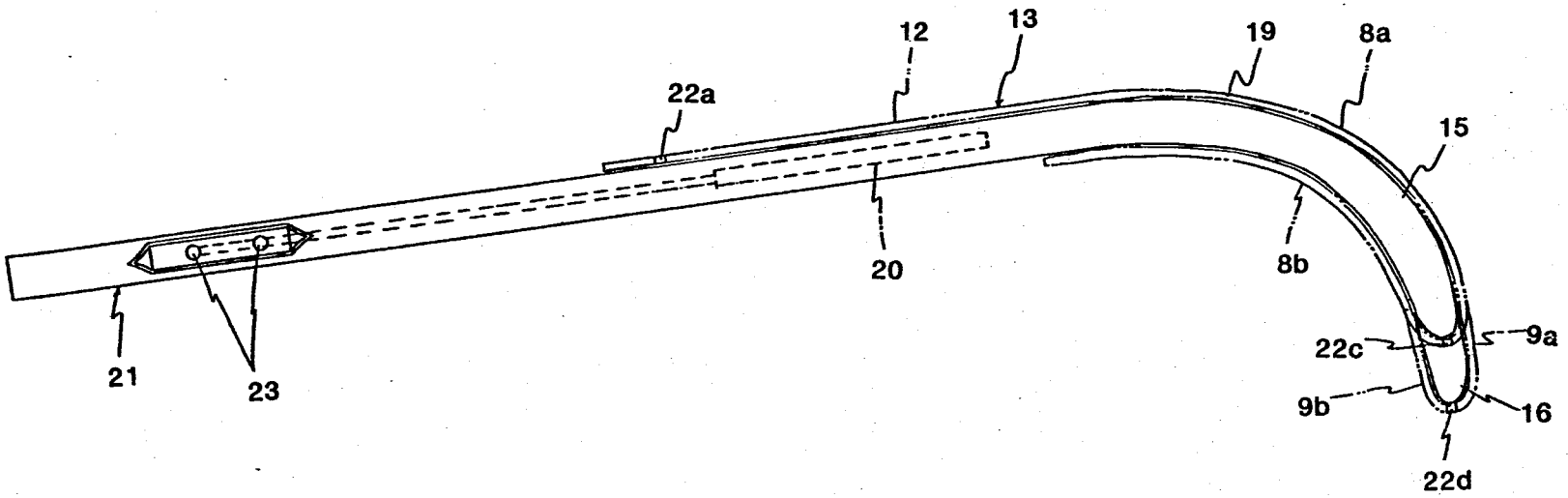
FIG. 6 is a side view of FIG. 4.

These small holes engage suitably spaced projections on the electrically heated form which is depicted in FIGS. 4, 5 and 6.

Thus, FIGS. 4 to 6 depict the electrically heated form to be inserted in the glove.

In electrically heated form (21) there is provided forefinger (15), middle finger (16), third finger (17), little finger (18), backside (19), electric heater element (20), plug (23) and projections (22*a*) and (22*b*) in proximity to the tail or cuff back portion. These projections engage holes (14*a*) and (14*b*) of paper sheet (12).

FIG. 5 depicting a view of the glove taken along line A–A$^1$, further depicts projections (22*c*), (22*d*), (22*e*) and (22*f*) which engage holes (14*c*), (14*d*), (14*e*) and (14*f*) on the paper sheet to firmly retain said paper sheet on the form.

After remaining on the form for a sufficient period of time, i.e. 60 to 70 sec., for a typical leather golf glove, the glove assembly with paper sheet therein is removed from the form.

By this method, the inside of the fingers are widened and easily retain their shape after removal from the electrically heated form.

The reason why the gloves become widened after this process is that before the paper sheet is affixed to the heated forms, the paper sheet has a straight shape as shown in FIG. 3. Then the paper layer remaining inside the gloves tends to return to such original shape and at the same time generates the strength to widen and retain the precurved shape of gloves. Without such sheet, this type of unlined gloves readily loses its shape and becomes flat.

The foregoing golf glove facilitates grasp of the golf club and curvature of the fingers is retained before actually being worn by golf players.

The gloves may be displayed with the paper layer therein to facilitate recognition of the curved fingers and to clearly distinguish it from conventional ones.

As suitable materials, there may be mentioned, as material for the gloves, in addition to genuine leather, synthetic resins, e.g. polyvinyl chloride type resins, polyurethanes and various textiles.

Various modifications of the foregoing invention will be apparent to those skilled in the art, for example, in determining the degree of curvature, number of fingers curved, etc.

I claim:

1. A method for retaining the shape of gloves with one or more curved fingers which comprises:

a. providing a glove with at least one curved finger, b. providing an electrically heated form having curved finger-like projections generally conforming to the shape of the fingers of said glove, c. inserting a sheet of paper generally conforming to the shape of said glove on said form, d. placing said glove over said electrically heated form whereby said paper sheet is interposed between said form and the interior of said glove, e. permitting said glove with said paper sheet to remain in contact with said heated form for a sufficient time to widen said fingers and cause them to retain their curvature, f. removing said gloves with said paper therein from said heated form.

2. The method according to claim 1 wherein said gloves are made of leather.

3. The method according to claim 2 wherein said gloves are golf gloves.

4. The method according to claim 2 wherein said gloves are baseball batters' gloves.

5. The method according to claim 1 wherein said electrically heated form has projections thereon for engaging said paper sheet and retaining it thereon.

6. The method according to claim 5 wherein said sheet extends outside said glove.

7. The method according to claim 6 wherein said sheet has holes in the cuff back area outside of said glove and at the mid-portions of the fingers of said gloves, which holes engage corresponding projections on said electrically heated form.

* * * * *